US012320600B2

(12) United States Patent
Gigliotti

(10) Patent No.: US 12,320,600 B2
(45) Date of Patent: Jun. 3, 2025

(54) REDUCED FRICTION, LOW PROFILE TRIGGER MECHANISM

(71) Applicant: Gregory Vincent Gigliotti, Reynoldsville, PA (US)

(72) Inventor: Gregory Vincent Gigliotti, Reynoldsville, PA (US)

( * ) Notice: Subject to any disclaimer, the term of this patent is extended or adjusted under 35 U.S.C. 154(b) by 67 days.

(21) Appl. No.: 18/491,955

(22) Filed: Oct. 23, 2023

(65) Prior Publication Data

US 2025/0130002 A1 Apr. 24, 2025

(51) Int. Cl.
*F41A 19/12* (2006.01)
*F41A 19/10* (2006.01)

(52) U.S. Cl.
CPC ..... *F41A 19/12* (2013.01); *F41A 19/10* (2013.01)

(58) Field of Classification Search
CPC ..... F41A 19/12; F41A 19/10
See application file for complete search history.

(56) References Cited

U.S. PATENT DOCUMENTS

2016/0161202 A1* 6/2016 Larue ..... F41A 19/45 42/69.01
2022/0018620 A1* 1/2022 Elftmann, Jr. ..... F41A 19/14
2023/0003476 A1* 1/2023 Markut ..... F41A 11/02

* cited by examiner

*Primary Examiner* — J. Woodrow Eldred
(74) *Attorney, Agent, or Firm* — Dunlap Bennett & Ludwig, PLLC

(57) ABSTRACT

A trigger mechanism assembly for a firearm provides a horizontal arrangement of its sear relative to a trigger of the firearm by way of a linkage bar. The sear and a disconnector share a pivot point, wherein at each engagement surface between the pivot point and the sear and the disconnector, respectively, there is a bearing. A pair of mandibles is provided, one mandible by each of the sear and the disconnector. A spring is operatively associated between the sear and the disconnector to bias them to rotate about the pivot point dependently, whereby a first distance between the pair of mandibles is maintained. An inclined surface is provided along at least one mandible so that a downward force urged by a hammer against the inclined surface moves the disconnector independently of the sear, whereby a second distance between the pair of mandibles is greater than the first distance.

10 Claims, 4 Drawing Sheets

REDUCED FRICTION, LOW PROFILE TRIGGER MECHANISM

BACKGROUND OF THE INVENTION

The present invention relates to firearm trigger mechanisms and, more particularly, to a reduced friction, low profile trigger mechanism.

As firearms become more compact, clearance for fire control mechanisms to properly function becomes more difficult. Typically triggers and fire control mechanisms are arranged vertically, relative to each other, requiring increased vertical height and clearance within the firearm housing. Specifically, such vertically arranged firing mechanisms keep the hammer and sears above the trigger, thus increasing the amount of overhead clearance and vertical height of the overall firearm.

In contrast, some firearm trigger mechanisms utilize a horizontal arrangement, wherein a horizontal rotation or pivoting configuration minimizes the vertical clearance. Horizontal rotation or pivoting firearm trigger mechanisms, however, require relatively significant horizontal distance (to accommodate the hammer and trigger being spaced horizontally apart) to operate and thus have considerable friction at the points of contact and at the axis of rotation of the fixed rotation points. This friction can be reduced using bearings at these points of contact, thus greatly reducing friction.

Some firearms utilize a linkage bar to separate the trigger shoe from the remaining fire control group and relocate the remaining components to a rearward area of the firearm. The issue of drag is exacerbated by linkage mechanisms and the length of the trigger pull, making for increased resistance and pull necessary to operate the firing components, and in turn resulting in a long, sloppy, take-up of the trigger pull, reducing accuracy and responsiveness of the firearm. Put simply, the inefficiency of the firing components is significantly increased when utilizing trigger linkages, which increase friction and decrease overall efficiency of the firing mechanism, resulting in a sub-optimal and excessively long trigger travel.

To recap, the conundrum of the prior art includes the following: (1) vertical fire control mechanisms require considerable height inside the firearm housing, which becomes problematic in more compact firearms; (2) mitigating vertical clearance by have a linkage increases friction and the overall force needed to operate the fire control mechanism, and increased friction can lead to decreased responsiveness and accuracy of the firearm; and (3) horizontal rotation firing mechanisms are degraded by the friction at points of contact.

As can be seen, there is a need for a low-profile trigger mechanism configured so that its horizontal rotation firing components are along the same plane as the trigger pull vector, thereby reducing friction with the use of bearings, and in turn increasing efficiency of pull and responsiveness of the fire control mechanism.

SUMMARY OF THE INVENTION

The present invention utilizes, in combination, both bearing assisted, single point horizontal pivoting of fire control components in combination with linkage trigger shoes. Previous means of fire control groups utilizing linkages either lacked horizontal motion to reduce height or lacked bearings and single point fixation to reduce friction and degree of rotation.

The present invention utilizes a low profile, low resistance, horizontal rotation of two separate but tethered arms with bearings around a single axis to allow for low overhead clearance as well as reduced friction during mechanical rotation of the fire control components.

Moving all components along the same plane as the trigger pull vector, utilizing horizontal rotation, and reducing friction with the use of bearings, results in an increased efficiency of pull and responsiveness of the fire control mechanism.

These and other features, aspects and advantages of the present invention will become better understood with reference to the following drawings, description and claims.

DETAILED DESCRIPTION OF THE INVENTION

Figure 1:
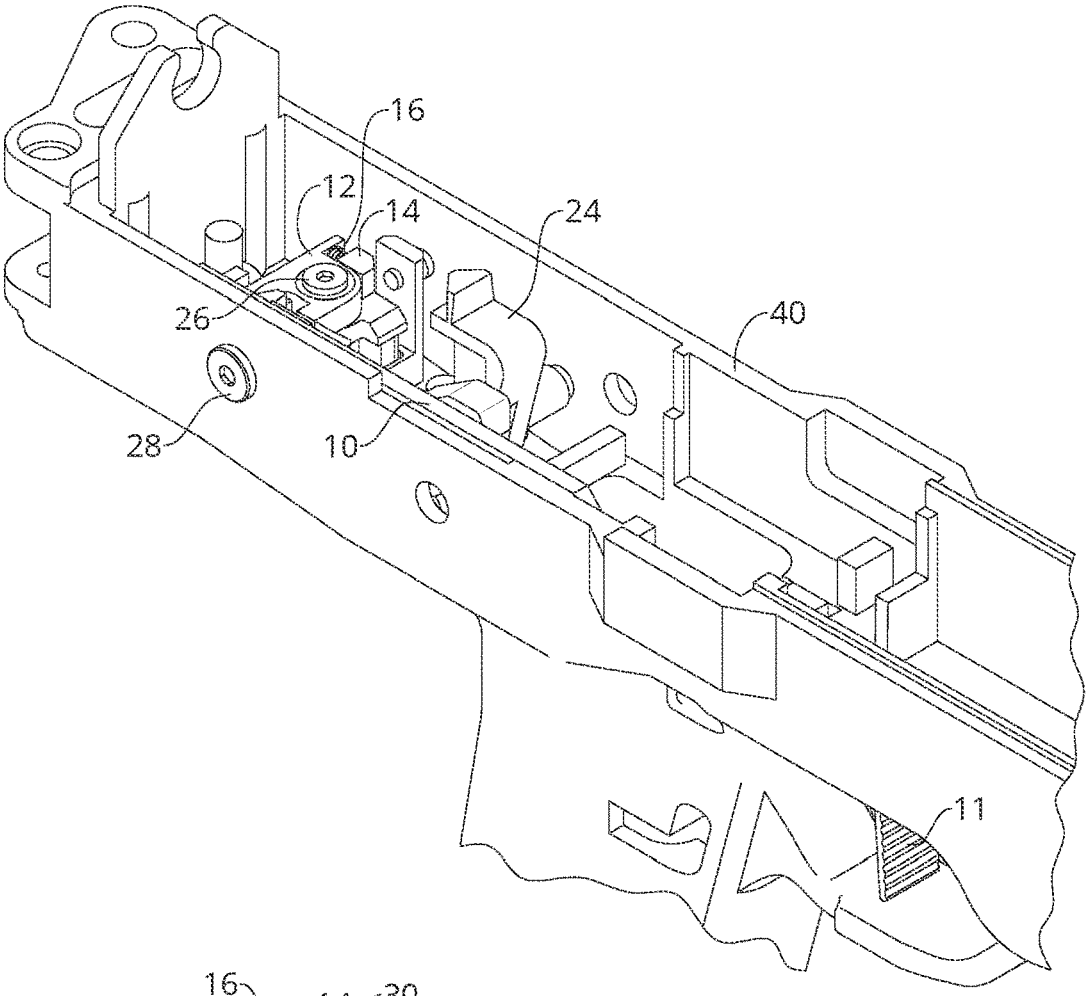
FIG. 1 is a perspective view of an exemplary embodiment of the present invention, shown in installed in a firearm housing 40.
Figure 2:
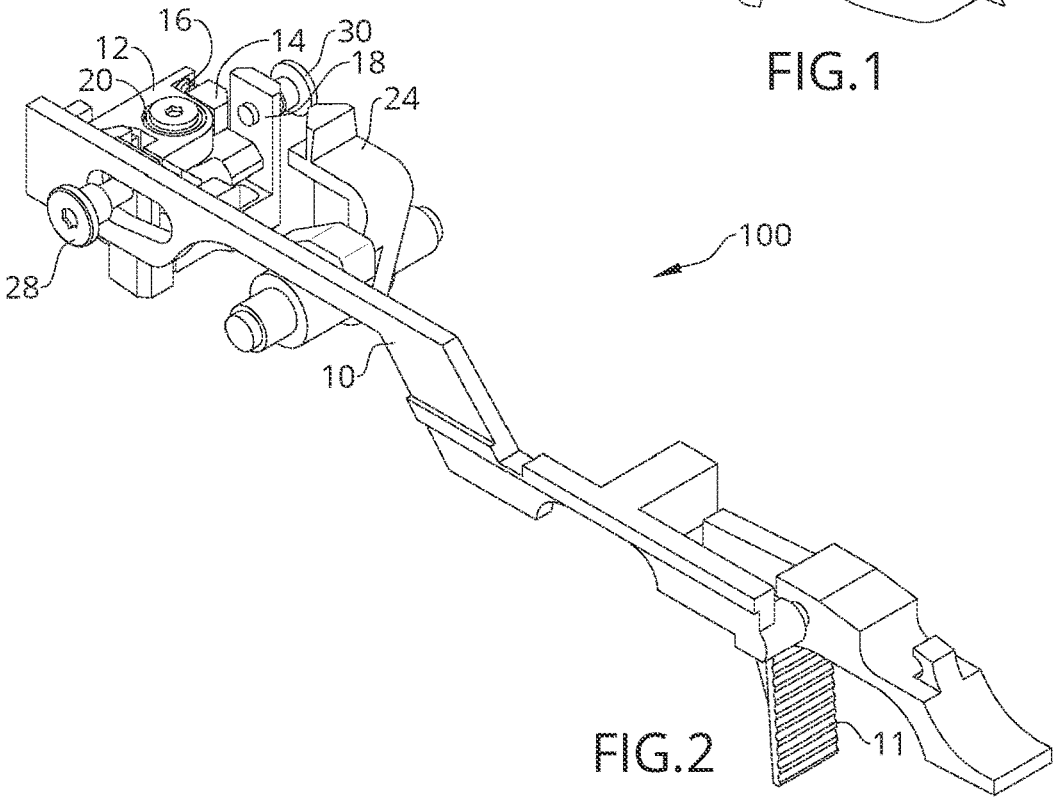
FIG. 2 is a perspective view of an exemplary embodiment of the present invention.
Figure 3:
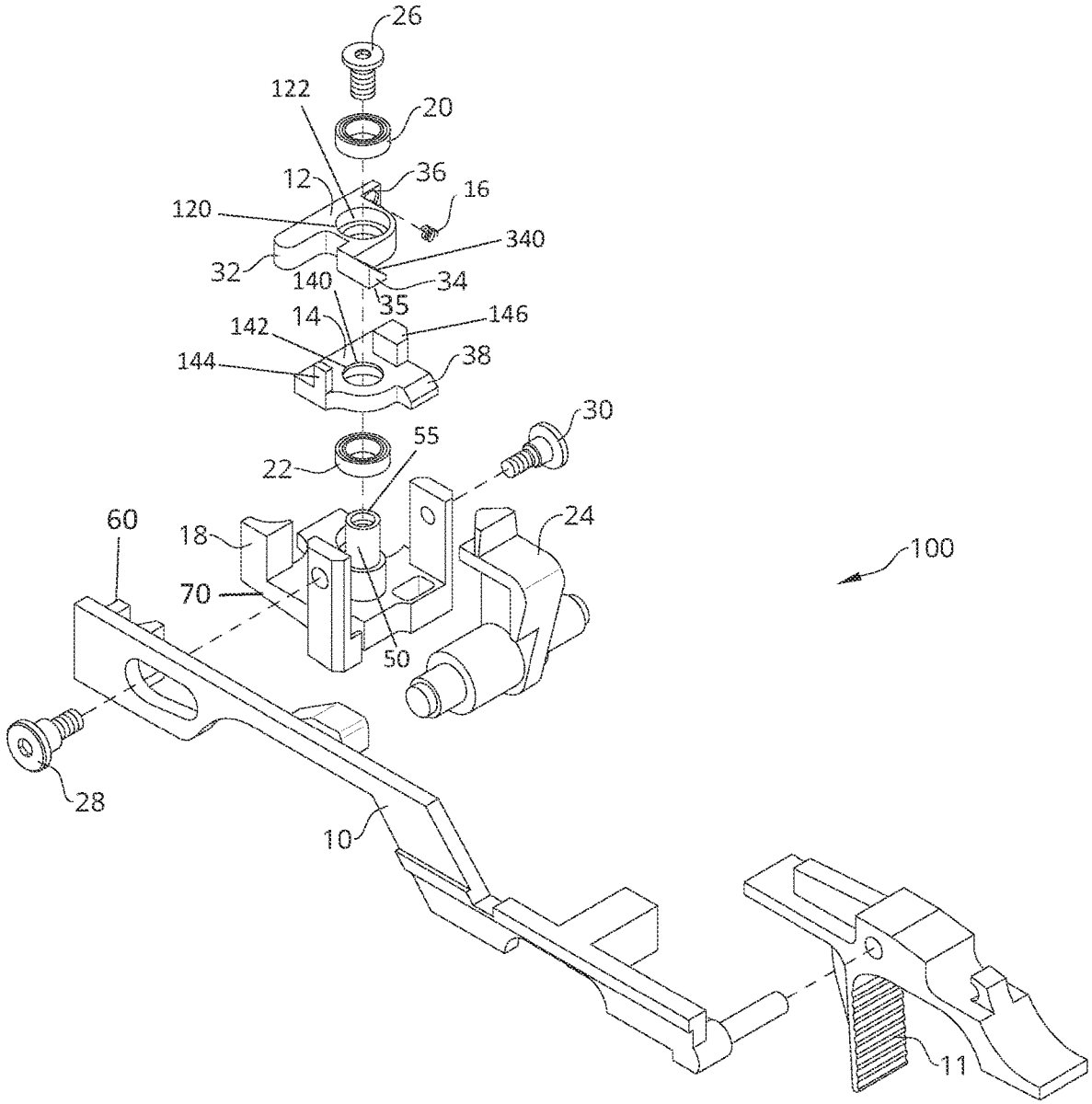
FIG. 3 is an exploded perspective view of an exemplary embodiment of the present invention.
Figure 4:
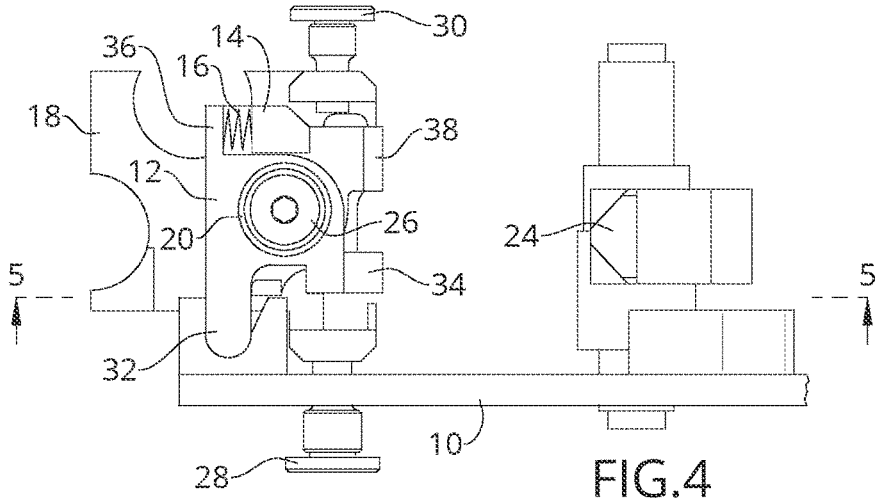
FIG. 4 is a detailed top plan view of an exemplary embodiment of the present invention.
Figure 5:
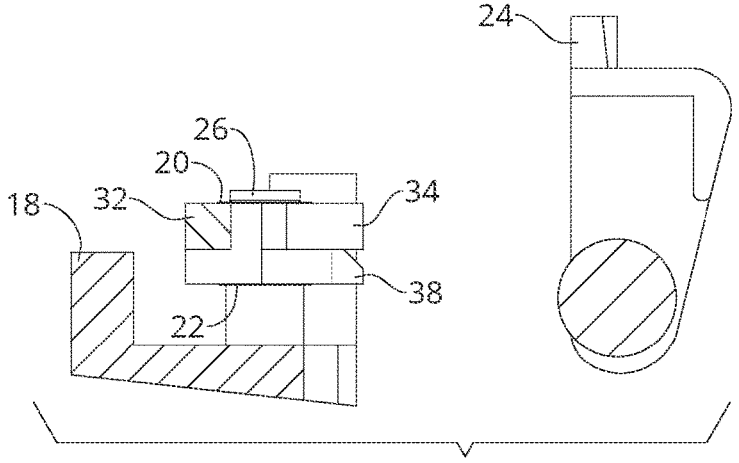
FIG. 5 is a section view of an exemplary embodiment of the present invention, taken along line 5-5 in FIG. 4.
Figure 6:
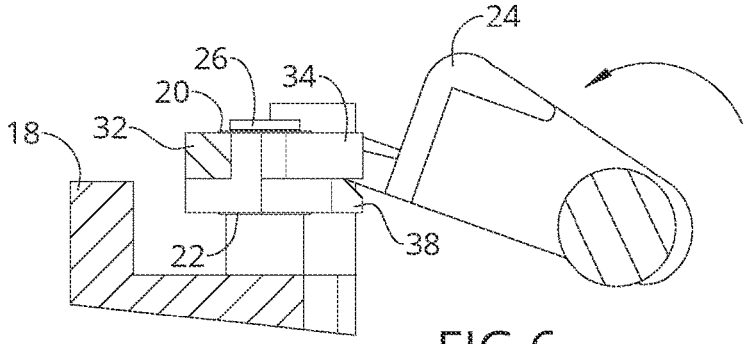
FIG. 6 is the same section view of FIG. 5 illustrating the motion of a hammer 24.
Figure 7:
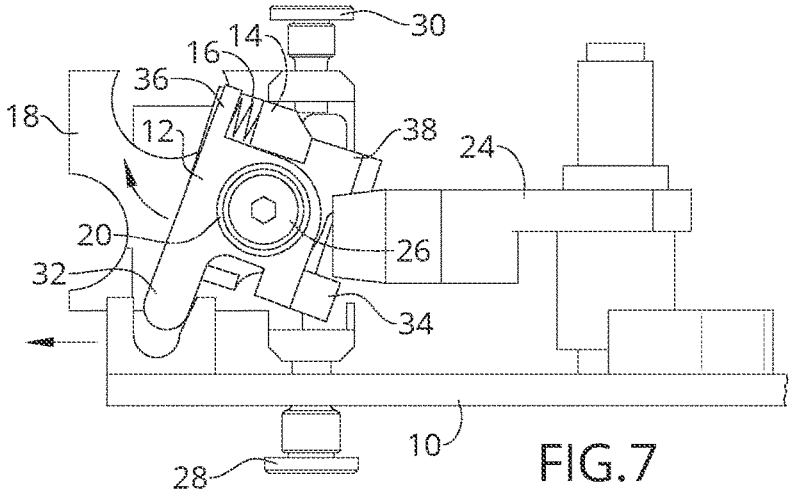
FIG. 7 is a detailed top plan view of an exemplary embodiment of the present invention, illustrating motion of a trigger bar linkage 10 and a sear 12.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Referring to FIGS. 1 through 9, the present invention embodies a trigger mechanism assembly 100 which provides a trigger bar linkage 10. The trigger bar linkage 10 is of sufficient length to connect the trigger 11 to the sear 12 and disconnector 14 which are both mounted posteriorly in the fire control housing 18. An engagement point 60 may be provided along a distal end of the trigger bar linkage 10, wherein the engagement point 60 operatively associates with a sear first arm 32 of the sear 12 during the trigger pull of the firing components. Thus, when the trigger bar linkage 10 moves rearward (during a trigger pull), the sear first arm 32 is moved rearward, thereby rotating the sear 12 about a pivot point 50. The engagement point 50 may be a U-shaped relief cut into the trigger bar linkage 10 dimensioned and adapted to encompass the sear first arm 32 of the sear 12. The trigger bar linkage 10 may be a rectangular metal component, though other geometrical and non-geometrical shapes of any suitable material may comprise the trigger bar linkage 10.

The sear 12 may also provide a sear second arm 36 and a sear third arm 34. The sear second arm 36 is on an opposite side of the pivot point 50 as the sear first arm 32, so that when, referring to FIG. 7, in the direction of the arrow (rearward), sear second arm 36 is rotated in the opposite direction (essentially forward). The second sear arm 36 provides a first mounting surface to accommodate the disconnector spring 16. The third sear arm 34 is forward of both the first and second arms 32 and 36. The third sear arm 34 provides a wedge face 340 that faces forward toward the hammer 24. Because of the inclined plane of wedge face 340, downward (normal) force from downward pivoting hammer 24 is converted to a lateral force perpendicular to the normal force against the inclined surface, thereby urging the sear 12 laterally.

The underside of the sear 12 may be flat to mitigate unintentional release of the hammer 24. An approximately centered through hole 120 (approximately 0.2 inches in diameter) is present through which the sear 12 may be mounted on the pivot point 50 (e.g., pressed onto a post 50) in the fire control housing 18. The sear 12 may also have a relief 122 for a sear bearing 20 to be pressed in place and aligned with the through hole 120 to accommodate mounting to the post 50. The sear 12 may metal component approximately 0.78×0.6 inches in length, but other materials and lengths are contemplated herein.

The trigger mechanism assembly 100 may provide a disconnector 14 with a forward-facing disconnector arm 38. The disconnector arm 38 provides a forward-facing inclined surface. This inclined surface, much like the wedge face 340 of the sear third arm 34, when urged downwardly upon by the hammer 24 converts that downward force into a perpendicular lateral force. Being that the disconnector arm 38 and the wedge face 340 are on opposing sides of the pivot point 50, they may work in concert when the hammer 24 is urged between when the hammer 24 pivot downward. The inferior surface of the disconnector arm 38 is flat to mitigate unintentional movement of the hammer 24.

There are two protrusions 144 and 146 on disconnector 14 on opposite sides thereof (relative to a disconnector through hole 140). The centered through hole may be present through which the disconnector 14 may be mounted or pressed onto said post 50 in the fire control housing 18. The disconnector 14 may also have a relief 142 for a disconnector bearing 22 to be pressed in place and aligned with the disconnector's 14 through hole 140 (having an approximately 0.2-inch diameter) to accommodate mounting to said post 50. The disconnector 14 may be a metal component approximately 0.6×0.6 inches in length, but other materials and lengths are contemplated herein. The first protrusion 144 serves as a contact surface with the sear 12 and the second protrusion 146 serves as a second mounting surface for the disconnector spring 16.

The disconnector spring 16 may be a coiled metal compression spring of approximately 0.25 inches in length, though other devices that can store energy when compressed may be used.

Figure 8:
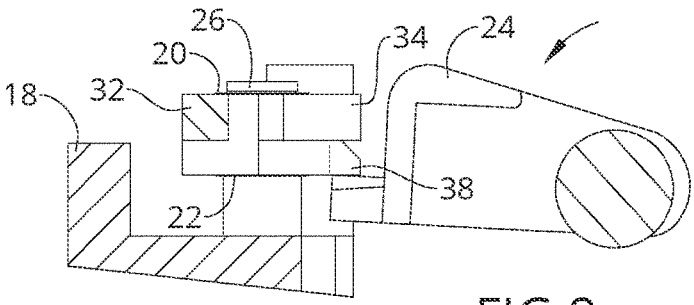
FIG. 8 is the same section view of FIG. 5 illustrating the motion of the hammer 24 engaging the disconnector 14 from below.
Figure 9:
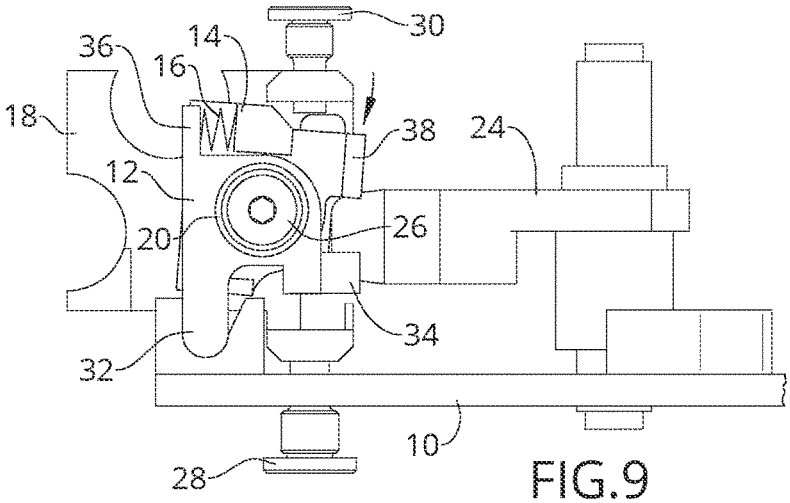
FIG. 9 is a detailed top plan view of an exemplary embodiment of the present invention, illustrating motion of the disconnector 14.

The fire control housing has a base 70 that has a roughly square footprint (approximately 1×1×0.78 inches), a flat superior surface, and an angled base, as seen best in FIG. 8, wherein the bottom of stop 18 is not 90 degrees, but rather sloped, getting thicker toward the front of the stop 18. Stop 18 is a protrusion that is dimensioned and adapted to prevent overtravel of the trigger bar linkage 10 when one pulls it rearward.

Two arms extending vertically from both sides of the base 70, and each has a fastener hole just downward of its upper elevation to accommodate a fastener 28, 30.

The post 50, typically cylindrical but not limited to that geometrical shape, with blind hole 55 may extend upward from the approximate middle of the base. The blind hole may be threaded to accommodate a first fastener 26. The post 50 is of complimentary size to the through holes 120 and 140 of the sear 12 and disconnector 14, and their respective bearings 20 and 22, to allow for fitment of the bearings over the post 50. The footprint of the fire control housing 18 may be cutout to fit the internal structures of the host firearm.

The sear bearing 20 may be a circular ball bearing with inner diameter complimentary to the size of the fire control housing post. The disconnector bearing 22 may be a circular ball bearing with inner diameter complimentary to the size of the fire control housing post.

The hammer 24 may be metal component of which has a superiorly flat surface and angled inferior surfaces that is hinged inside the host firearm. The importance of these shapes/surfaces is in relationship to the shoulder portion at the top there is a triangular looking protrusion. When the hammer 24 rotates rearward (down), that triangle shape acts like an ax or wedge, which will hit either or both the wedge surface 340 and/or the inclined surface of the disconnector arm 38 depending on where the trigger 11 is during the firing cycle. The hammer 24 will hit these surfaces and cause the sear 12 or disconnector 14 to move out of the way. The flat side of the triangle on the hammer 24 will be caught by the flat (under) surface of the disconnector arm 38 as once the hammer 24 passes by, the pivotal movement of the disconnector 14 is urged back to catch the hammer 24. The disconnector arm 38 is of of sufficient length to match the depth of threads and a head with wide enough diameter to hold components in place beneath.

As the trigger bar linkage 10 is pulled rearward, it contacts the sear 12 and begins rotating the sear 12 laterally. As the sear 12 and the sear bearing 20 begin to rotate, the disconnector spring 16 forces the disconnector 14 and the disconnector bearing 14 to rotate in the same direction inside the fire control housing 40. As the sear 12 clears the hammer 24, the hammer 24 can pivot upward. If the trigger bar linkage 10 is held rearward, the firearm bolt will cycle, subsequently depressing the hammer 24, which will contact the slanted face of the disconnector 14, forcing the disconnector spring 16 to compress. This compression allows for slight lateral rotation of the disconnector 14, enough for the hammer 24 to pass the disconnector 14. As the hammer 24 clears the disconnector 14, the disconnector spring 16 decompresses, pushing the disconnector 14 into position above the hammer 24. By capturing the hammer 24 and holding in place, premature cycling of the hammer 24 is prevented. As the trigger bar linkage 10 is released forward, it again contacts the sear first arm 32 of the sear 12, rotating the component in the opposite direction. As this rotation occurs, the sear 12 will contact the raised first protrusion 144 the disconnector 14, causing both to continue pivoting in conjunction and in the reverse direction. As both components pivot on their bearings at the same single point of axis, the lower disconnector 14 will rotate off the hammer 24. As disconnector 14 rotates away from the center and off the hammer 24, the hammer 24 is released upward, only to be caught above by the flat undersurface 35 of the sear 12. The firearm is then ready to cycle once more and may do so as the trigger bar linkage 10 is moved rearward.

A method of making the present invention may include the following. The bearings are installed into their respective components, which are then placed on the mounting post of the fire control housing as previously described. The disconnector spring is installed between the mounting points on the sear and disconnector. Both the sear and disconnector are hold in place within the housing by a screw. The entire fire control housing unit is placed inside the host firearm and secured in place with screws. The trigger linkage bar fits around the sear arm.

All elements are necessary. Screws could be substituted by pins or other fasteners.

The height of the sear and disconnector components could be altered for specific applications. Additionally, the angles of the faces of the sear and disconnector can also be reconfigured for differing tension and application.

A method of using the present invention may include the following. The trigger mechanism assembly 100 disclosed above may be provided. To use the present invention, one need only to install the completed drop in firing control unit into the host firearm in place of the original firing mechanism, fasten the invention with screws or pins to frame of the host firearm, and ensure the trigger linkage is in place so as to make contact with the with sear arm. The invention is self-contained and therefore the issues of height and friction are alleviated. Alternatively, this invention may be preinstalled by an original equipment manufacturer (OEM) which would not require any installation prior to utilization.

As used in this application, the term "about" or "approximately" refers to a range of values within plus or minus 10% of the specified number. And the term "substantially" refers to up to 80% or more of an entirety. Recitation of ranges of values herein are not intended to be limiting, referring instead individually to any and all values falling within the range, unless otherwise indicated, and each separate value within such a range is incorporated into the specification as if it were individually recited herein.

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the invention as set forth in the following claims.

What is claimed is:

1. A trigger mechanism assembly for a firearm, the assembly comprising:

a sear and a disconnector concentrically sharing a pivot point;

a sear bearing and a disconnector bearing operatively associated with the sear and the disconnector, respectively, and the pivot point; and a horizontal-oriented linkage bar having a distal end and a proximal end, wherein the distal end is directly connected to the sear and the proximal end is operatively associated with a trigger of the firearm.

2. The assembly of claim 1, wherein a distance between the distal and proximal ends is at least one-half an inch.

3. A trigger mechanism assembly for a firearm, the assembly comprising:

a pivot point;

a sear rotatably mounted to the pivot point;

a disconnector rotatably mounted to the pivot point;

wherein each rotatable mount comprises a bearing; and a horizontal-oriented linkage bar having a distal end and a proximal end, wherein the proximal end operatively associated with a trigger of the firearm, and wherein the distal end is directly connected to the sear so that the sear is movable between a disengaged position and an engaged position for engaging a hammer of the firearm in a cocked condition.

4. The assembly of claim 3, wherein the sear provides a sear forward arm, and wherein the disconnector provides a disconnector forward arm, and wherein the forward arms are laterally spaced apart for receiving the hammer.

5. The assembly of claim 4, a spring operatively disposed between the sear and the disconnector, wherein the spring biases the forward arms at the predetermined distance.

6. The assembly of claim 5, wherein the disconnector forward arm provides an inclined surface for converting a downward force on the inclined surface to a lateral force rotating the disconnector about the pivot point independently of the sear, whereby the downward force is caused by the hammer moving to the cocked condition.

7. The assembly of claim 6, wherein the sear has a first sear arm and a second sear arm, wherein the first sear arm is directly connected to said distal end, and wherein the second sear arm operatively associates with the spring.

8. The assembly of claim 7, wherein the disconnector provides a protrusion against with the spring is mounted relative to the second sear arm.

9. The assembly of claim 8, wherein the disconnector forward arm has a wedge-shape surface.

10. The assembly of claim 9, wherein a horizontal distance between trigger and the pivot point is at least one-half of an inch.

* * * * *